US007824076B2

(12) United States Patent
Koester

(10) Patent No.: US 7,824,076 B2
(45) Date of Patent: Nov. 2, 2010

(54) LED REFLECTOR LAMP

(76) Inventor: George H. Koester, 9855 Beauclerc Ter., Jacksonville, FL (US) 32225

( * ) Notice: Subject to any disclaimer, the term of this patent is extended or adjusted under 35 U.S.C. 154(b) by 208 days.

(21) Appl. No.: 12/156,543

(22) Filed: Jun. 2, 2008

(65) Prior Publication Data

US 2009/0002997 A1 Jan. 1, 2009

Related U.S. Application Data

(60) Provisional application No. 60/932,434, filed on May 31, 2007.

(51) Int. Cl.
*F21V 29/00* (2006.01)

(52) U.S. Cl. ..... 362/294; 362/240; 362/249.02; 362/247

(58) Field of Classification Search ..... 362/294, 362/240, 249.02, 247, 545, 345, 800
See application file for complete search history.

(56) References Cited

U.S. PATENT DOCUMENTS 5,561,346 A * 10/1996 Byrne ..... 313/512
6,220,722 B1 * 4/2001 Begemann ..... 362/231
6,525,668 B1 * 2/2003 Petrick ..... 340/815.45
6,682,211 B2 * 1/2004 English et al. ..... 362/545
7,008,095 B2 * 3/2006 Coushaine et al. ..... 362/545
7,052,166 B2 * 5/2006 Tessnow ..... 362/647
7,158,019 B2 * 1/2007 Smith ..... 340/467
7,207,695 B2 * 4/2007 Coushaine et al. ..... 362/240
7,347,584 B2 * 3/2008 Sun et al. ..... 362/218
7,520,634 B2 * 4/2009 Ducharme et al. ..... 362/276

* cited by examiner

*Primary Examiner*—Sandra L O Shea
*Assistant Examiner*—Danielle Allen
(74) *Attorney, Agent, or Firm*—Thomas C. Saitta

(57) ABSTRACT

A lamp having a reflective surface, a pedestal positioned within the interior defined by the reflective surface, and one or more light emitting diodes (LED's) mounted onto one or more occluding faces on the pedestal, such that each occluding face blocks light emitted from the LED's from a portion of the reflective surface. The occluding faces are oriented parallel to or at an acute angle to the central axis of the reflective surface.

10 Claims, 11 Drawing Sheets

LED REFLECTOR LAMP

This application claims the benefit of U.S. Provisional Patent Application Ser. No. 60/932,434, filed May 31, 2007, the disclosure of which is incorporated herein by reference.

BACKGROUND OF THE INVENTION

This invention relates generally to the field of reflector lamps and more particularly to the field of reflector lamps comprising one or more light emitting diodes (LED) as the illumination source. Even more particularly, this invention relates to any such LED reflector lamps that project one or more controlled, directional light beams or patterns.

Reflector lamps comprising an illumination source and a reflective surface are well known, and are found in such devices as flashlights, spotlights, automobile headlights or the like. Various illumination sources may be used, such as for example an incandescent filament bulb, a high intensity discharge lamp, a florescent lamp or an LED. A shaped reflective surface surrounds the illumination source and directs the light photons emitted from the illumination source in a controlled manner to produce, for example, a circular beam pattern as found in a spotlight. Most commonly the shaped reflective surface is parabolic, although elliptical, segmented, polygonal or flat surfaces are known, and the surface is covered with a polished aluminum metal, such that the lamps are generally referred to as parabolic aluminized reflector (PAR) lamps. The position of the illumination source relative to the focal point of the parabolic reflector and the particular shape of the parabolic reflective surface determine the pattern or shape of the projected light beam. Often, the reflected light is passed through a refractive optical lens to refine the light beam pattern.

One shortcoming of these typical reflector lamps is that a significant portion of the light emitted from the illumination source is wasted, since only a portion of the emitted light falls on the desired area of the reflective surface. The remainder of the emitted light is either not reflected at all or is reflected in an undesirable manner outside of the desired light beam pattern. Another shortcoming is that an optical refractive lens is required for many applications, which raises the cost of manufacture and the expense of repair should the lens be damaged. Another shortcoming is that multiple lamps are often required when it is desired to project multiple or distinct beam patterns, such as on an automobile where low driving beams, high driving beams, turning signals, emergency flashers, etc. are required.

LED's require less lumens-per-watt of electrical power to produce light, have longer average life expectancy than other forms of incandescent lamps, are more resistant to damage from vibration and shock, offer much greater reliability, maximize the cost to lumens ratio for effective cost savings, and are environmentally friendly.

It is an object of this invention to provide an LED reflector lamp that solves the problems set forth above. It is a further object of this invention to provide such a device wherein one or more LED's are mounted to one or more occluding faces of a pedestal extending into the interior of the reflector surface, the faces of the pedestal being disposed toward the interior or rear of the parabolic reflector at an angle to the central axis of from zero to approximately 30 degrees, whereby the combination of the location of the LED's, the shape of the reflective surface, the angles of the faces and the occlusion range of the faces determines the shape of the light beam projected from the lamp. It is a further object of this invention to provide such a device wherein a refractive optical lens is not required to control the projected light beam. These objects, along with other objects not expressly set forth above, will be apparent upon examination of the disclosure herein.

The present invention may be used for, among other things, highway vehicle headlights, backup lights, work lights, emergency lights, aircraft landing/taxing lights, aircraft guide way landing lights and on all forms of motorized vehicles; such as, but not limited to, automobiles, motorcycles, trucks, buses, aircraft, farm equipment, construction equipment, off road vehicles, trains, other rail vehicles, railroad wayside signals, highway traffic control signals and replacement for any PAR type or light fixture with a reflective device for forming a beam pattern.

SUMMARY OF THE INVENTION

In general, the invention is a reflective lamp comprising a reflective surface of chosen configuration, typically a parabolic configuration, and one or more light emitting diodes (LED's) as the illuminating source. The LED's are mounted on one or more occluding faces of a pedestal member that extends into the interior of the reflective surface. The occluding faces are disposed at an acute angle from the central axis with the faces either parallel to the axis or rearward inclined toward the interior of the reflective surface. Each face defines the maximum area or angle of dispersion of the light from the LED, such that for a given face having a planar surface light from an LED is emitted at most over a hemispherical area and will be reflected by only a portion of the reflector surface, thereby maximizing the projected lumens and particularly defining the direction and shape light beam projected from the lamp.

In various embodiments, the pedestal may comprise two opposing faces, two pairs of opposing faces, four pairs of opposing faces, an odd number of faces, or the like. Single or multiple LED's, of the same or different colors, may be disposed on a chosen face. The LED's on a given face may be operable collectively or individually. The LED's on separate faces may also be operated individually or collectively. The pedestal comprises the primary heat sink for the LED's, and additional heat sink members for dispersion of the heat or for concentration of the heat near the transparent cover of the lamp for defogging or defrosting purposes may be provided on the pedestal. A non-reflected, forward-projecting LED may be positioned on the front of the pedestal. Preferably the pedestal base is configured such that the pedestal and its LED's may be received within standard reflector lamp housings. The control electronics and/or power source may be provided as a part of the pedestal base.

DETAILED DESCRIPTION OF THE INVENTION

With reference to the drawings, the invention will now be described in detail with regard for the best mode and preferred embodiments. In a most general sense, the invention is a reflector lamp using one or more light emitting diodes (LED's) as illumination sources.

Figure 1:
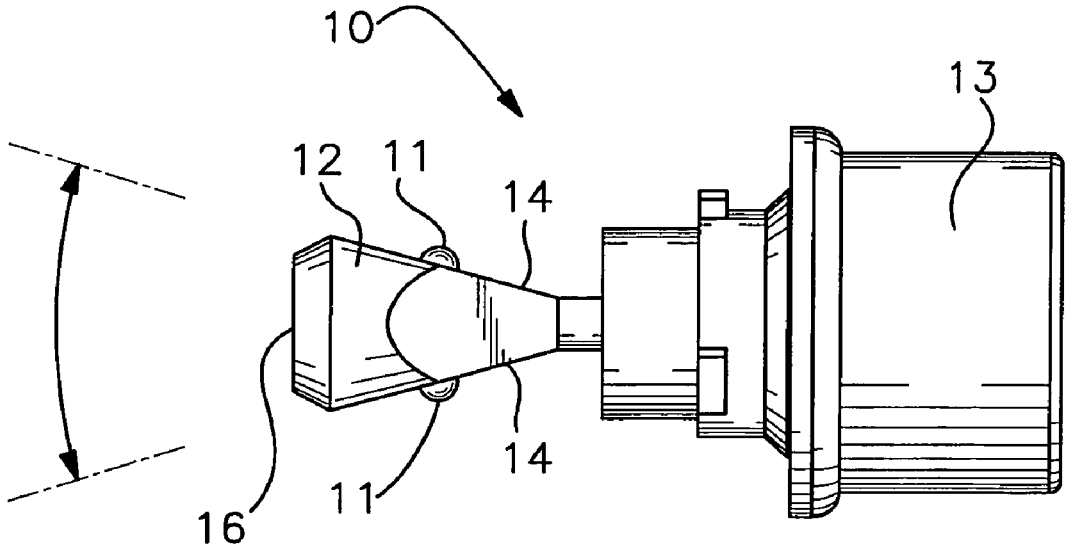
FIG. 1 is a side view of an embodiment showing the operational components of the invention, to with multiple LED's, the pedestal with opposing occluding faces and the mounting base, shown here as comprising the power supply and controller.
Figure 2:
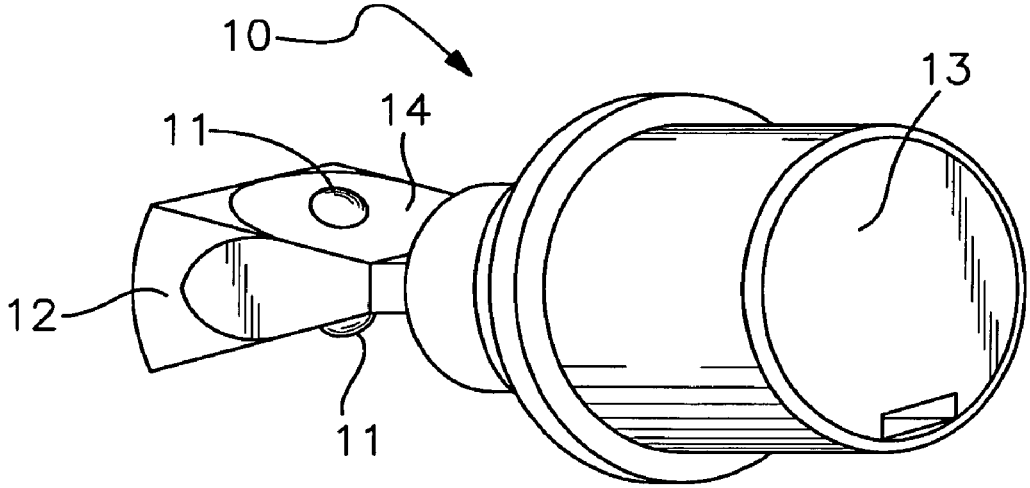
FIG. 2 is a perspective view of the operational components of FIG. 1, shown from a rearward angle.
Figure 3:
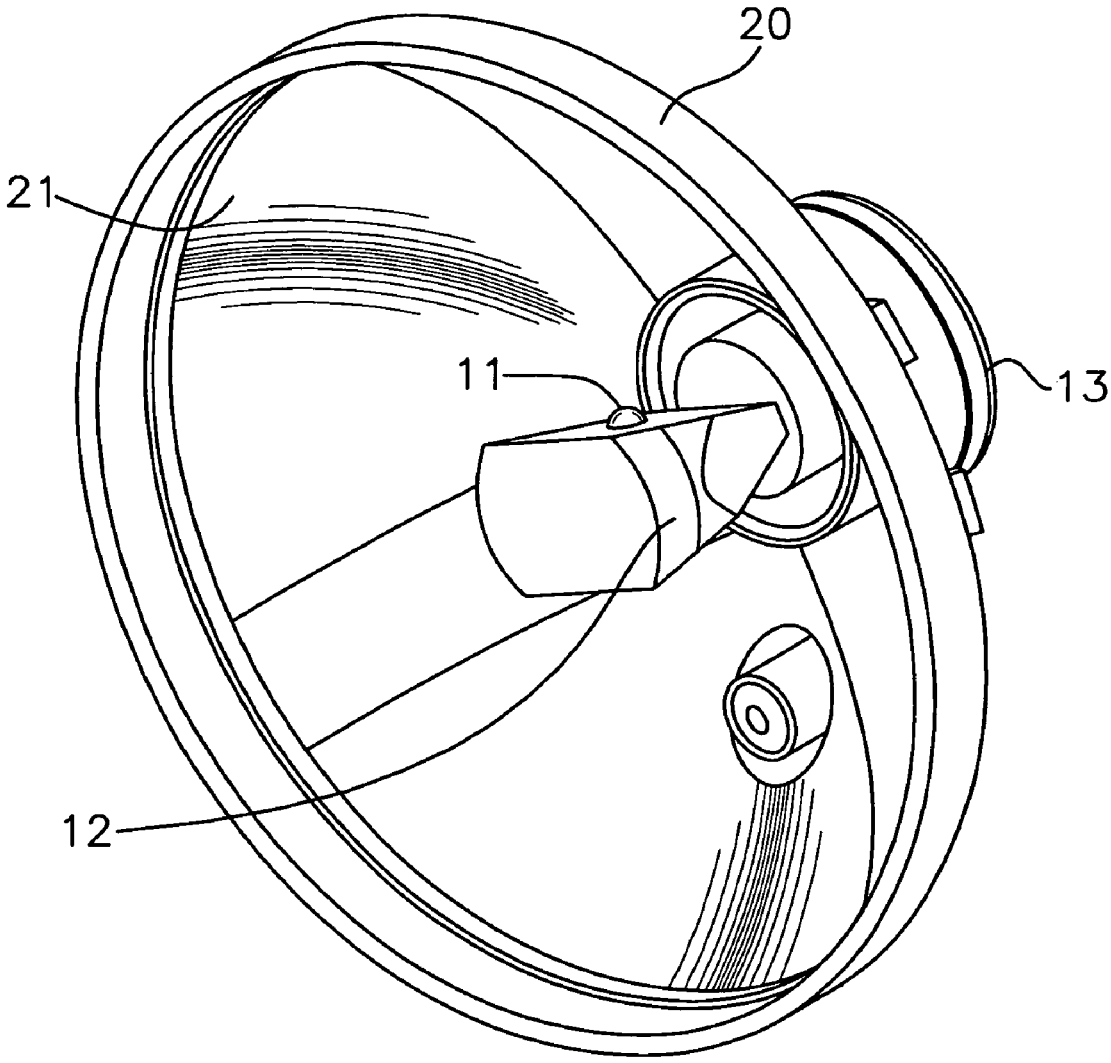
FIG. 3 is a forward perspective view showing an embodiment of a reflector lamp comprising the operational components of FIG. 1 mounted therein.

As shown in FIGS. 1 through 3, the LED reflector lamp comprises an assembly of operational components 10 mounted within a lamp housing 20. The lamp housing 20 comprises an internally disposed reflective surface 21, typically composed of a polished aluminum or similar light reflective material. The reflective surface 21 is configured so as to capture light from an LED illumination source 11 and project it from the lamp housing 20 in a controlled direction and pattern or shape. The reflective surface 21 as illustrated is shown as having a parabolic configuration, but it is contemplated that other shapes, such as for example and not limited to elliptical, segmented, polygonal, etc., may be utilized for specific applications. The reflective surface 21 defines an interior area or space. A front cover or lens (not shown), which does not need to be refractive or optically selective, may be positioned on the front of the lamp housing to protect the operational components 10 and the reflective surface 21.

The operational components 10 comprise one or more LED's 11 mounted or disposed on a pedestal member 12—either on the surface of or recessed into occluding faces 14 of the pedestal member 12—with the LED's acting as single light point source. The operational components 10 are affixed to or mounted in the lamp housing 20 such that the pedestal 12 extends forward and into the interior of the reflective surface 21. In a typical structure as shown, the operational components 10 are mounted within an opening provided in the rear of the reflective surface 21 such that the pedestal 12 is positioned on the central axis of the reflective surface 21, with the LED's 11 disposed generally symmetrically about the central axis and at or near the focal point of the reflective surface 21. The operational components 10 may further comprise a power supply and/or controller base 13 extending to the rear of the pedestal member 12, such power supply/controllers 13 being known in the art for controlling illumination of single or multiple LED's, controlling colors, controlling brightness, etc. The pedestal 12 is most preferably composed of a material that enables the pedestal 12 to act as the primary heat sink for the LED's 11 by drawing and dissipating the heat produced, such as for example a polycarbonate or other plastic, a metal, a resin, a ceramic, etc.

The axially aligned pedestal 12 comprises at least one occluding face 14, and typically comprises a plurality of non-opposing or opposing faces 14. Opposing faces 14 are oriented generally at approximately 180 degrees relative to the central axis. The faces 14 are preferably planar, but other surface configurations may be utilized to optimize the functionality of the face 14 in given situations. Each face 14 is positioned on the pedestal 12 either parallel to or at an acute angle to the central axis of the reflective surface 21, and preferably at an angle between zero and 30 degrees. The angled faces 14 are rearward inclined, such that each face 14 is oriented toward the rear or interior of the reflective surface 21 and housing 20. Defined in another manner, the face 14 is angled from 60 to 90 degrees off a plane perpendicular to the central axis. Each face 14 occludes or blocks light emitted from the LED 11 mounted on the face 14, such that light emitted from the LED 11 strikes only a selected target portion of the reflective surface 21, the target portion being less than a 360 degree range and typically being approximately 180 degrees or less. Thus, a planar face 14 will, if the lateral dimensions of the face 14 relative to the height of the LED 11 are great enough, generally only allow light to spread in a hemispherical area about the LED 11, while preventing light from striking the reflective surface 14 to the sides or rear of the face 14.

Figure 4:
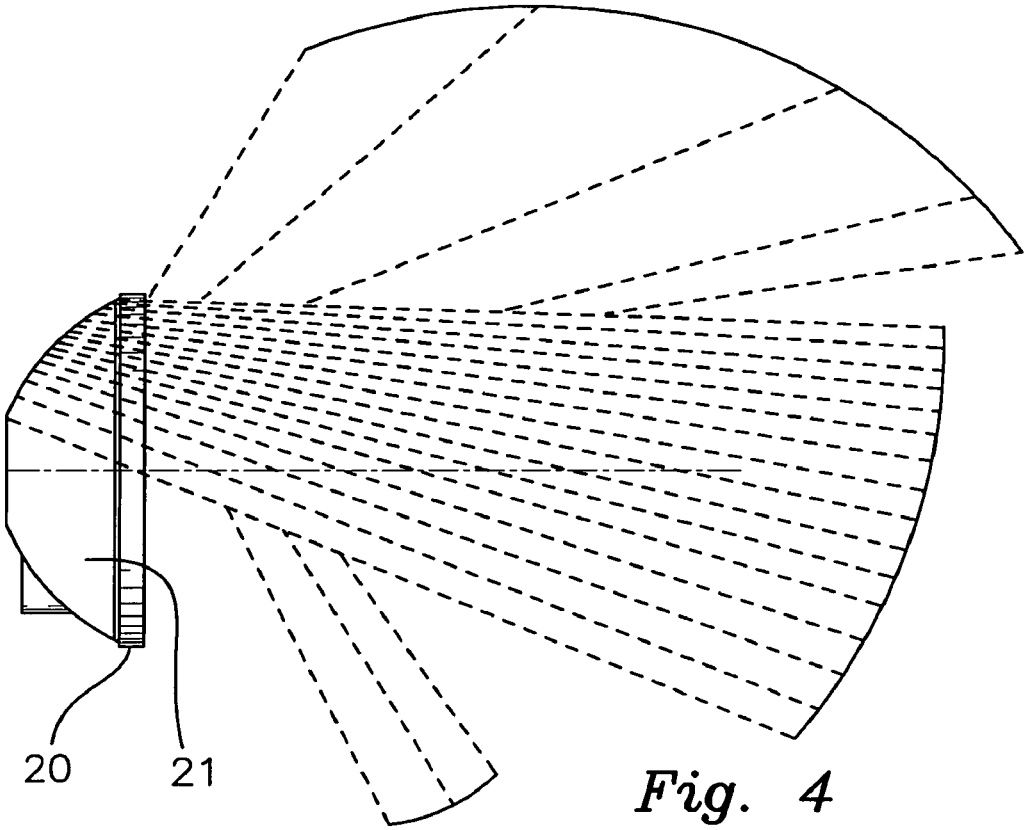
FIG. 4 is a side view illustrating the projected beam pattern when the uppermost LED of the lamp of FIG. 3 is illuminated, the lamp in this illustration representing an automobile headlight and the projected beam being a low beam pattern.
Figure 6:
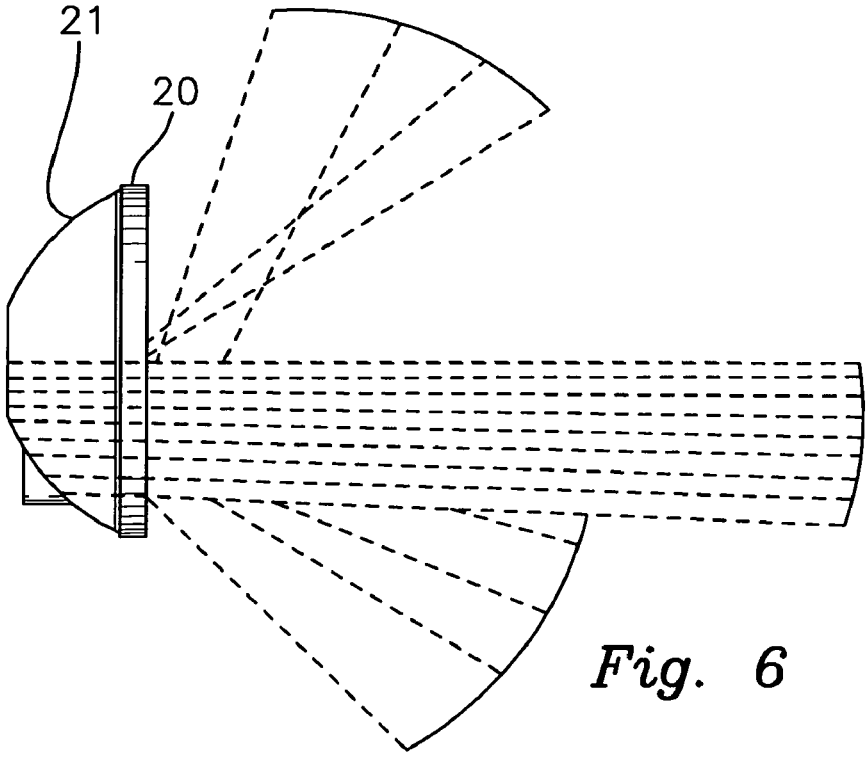
FIG. 6 is a side view illustrating the projected beam pattern when the lowermost LED of the lamp of FIG. 3 is illuminated, the lamp in this illustration representing an automobile headlight and the projected beam being a high beam pattern.
Figure 5:
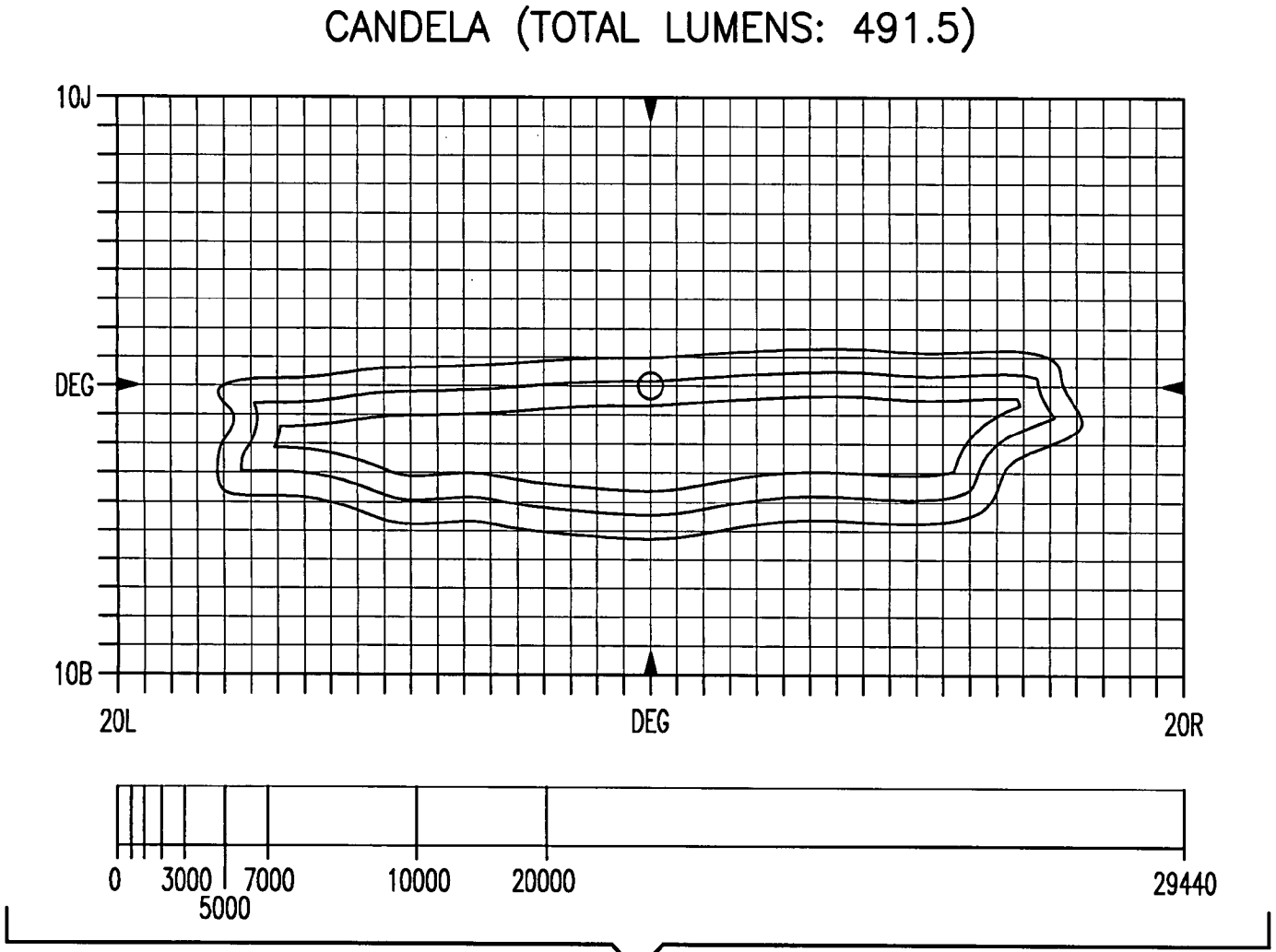
FIG. 5 is a graph showing the horizontal and vertical spread of the low beam pattern of FIG. 4.
Figure 7:
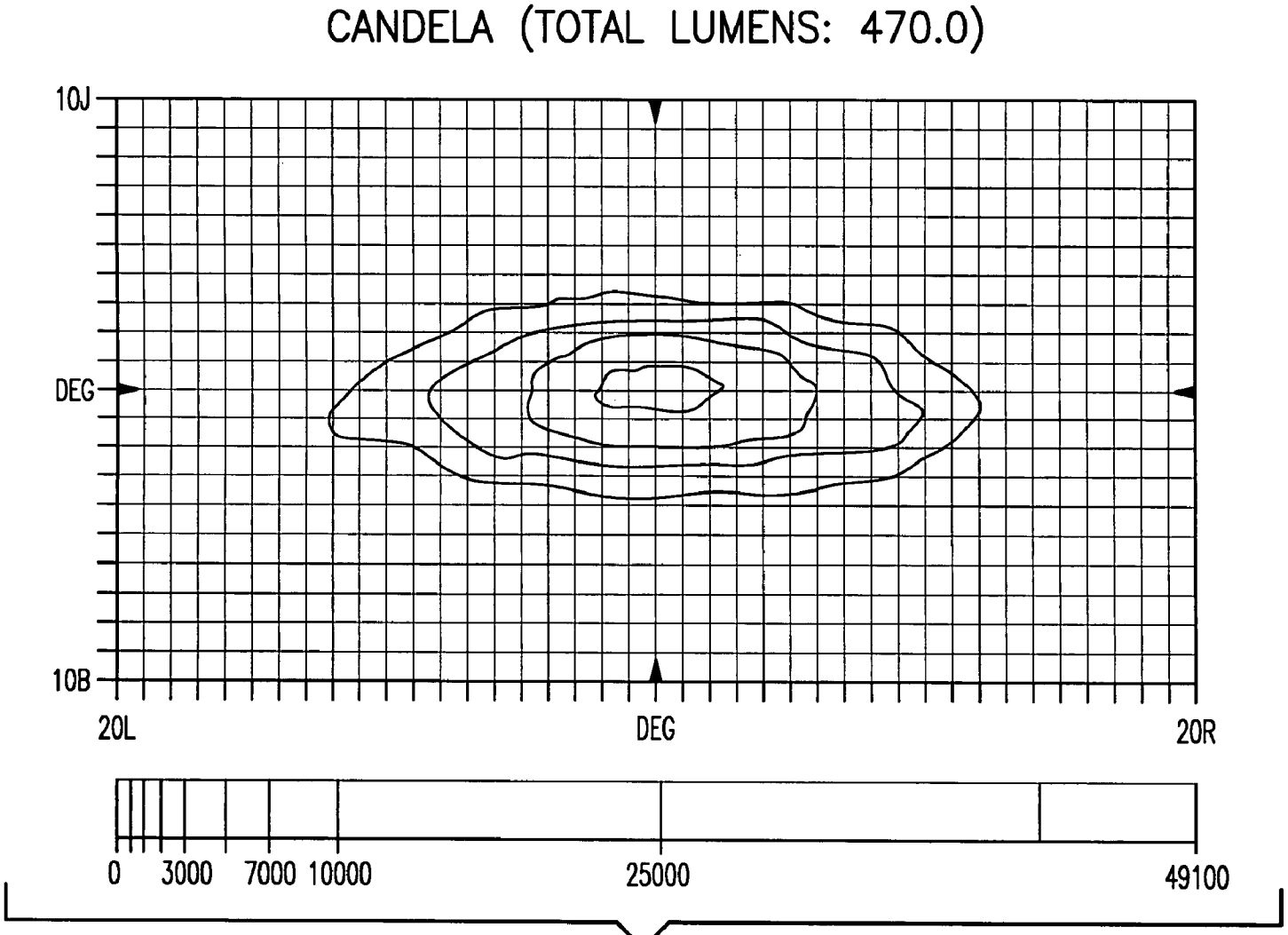
FIG. 7 is a graph showing the horizontal and vertical spread of the high beam pattern of FIG. 6.

In the embodiment of FIGS. 1 through 3, the pedestal 12 is multi-faceted and comprises a pair of opposing faces 14, each face 14 having a single LED 11 mounted thereon. The faces 14 are oriented at an angle of 15 degrees from the central axis, and are shown as being oriented so as to define upper and lower faces 14. In this configuration, when the uppermost LED 11 is illuminated, the emitted light strikes only the upper portion of the reflective surface 21, as shown in FIG. 4, producing a beam pattern as shown in FIG. 5. Alternatively, when the lowermost LED 11 is illuminated, the emitted light strikes only the lower portion of the reflective surface 21, as shown in FIG. 6, producing a beam pattern as shown in FIG. 7. This embodiment is representative of an LED reflective lamp suitable for use as an automobile headlight, for example, such that FIGS. 4 and 5 are representative of a low driving beam and FIGS. 6 and 7 are representative of a high driving beam.

Figure 8:
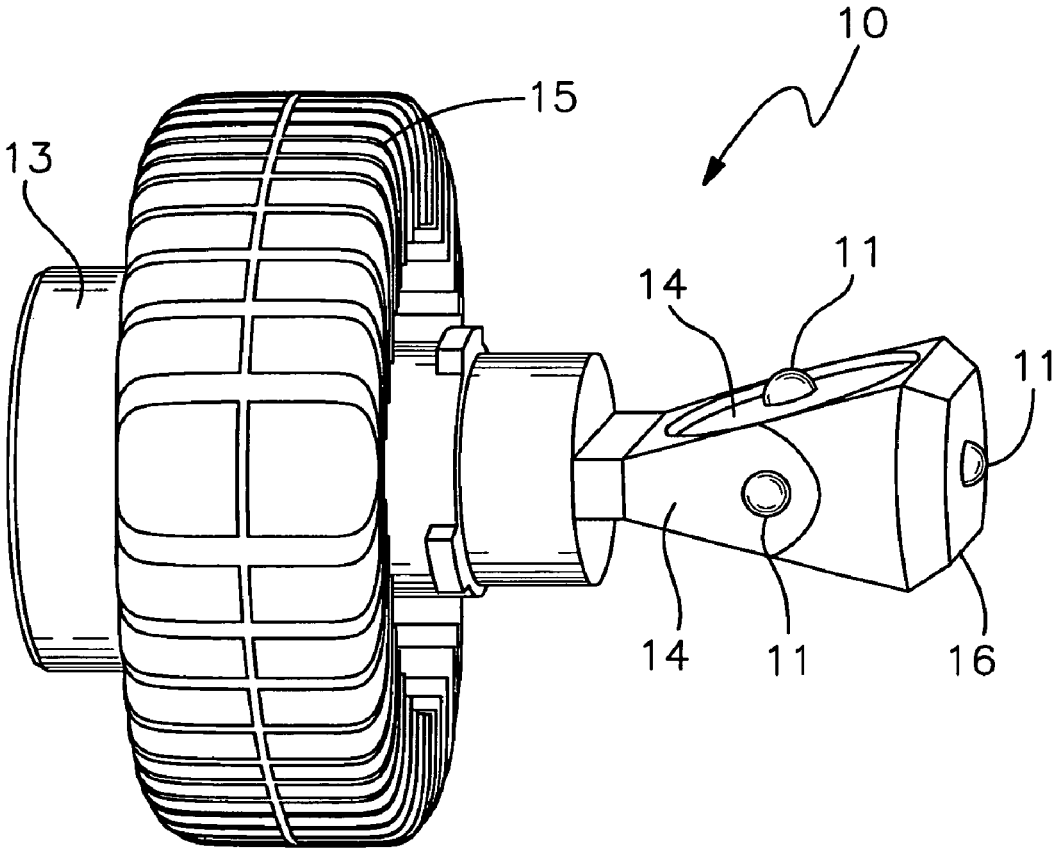
FIG. 8 is a perspective view of an embodiment of the operational components, the embodiment comprising two pairs of opposing faces, an LED mounted on each face, an LED mounted on the forward end of the pedestal, and an annular heat sink member.
Figure 9:
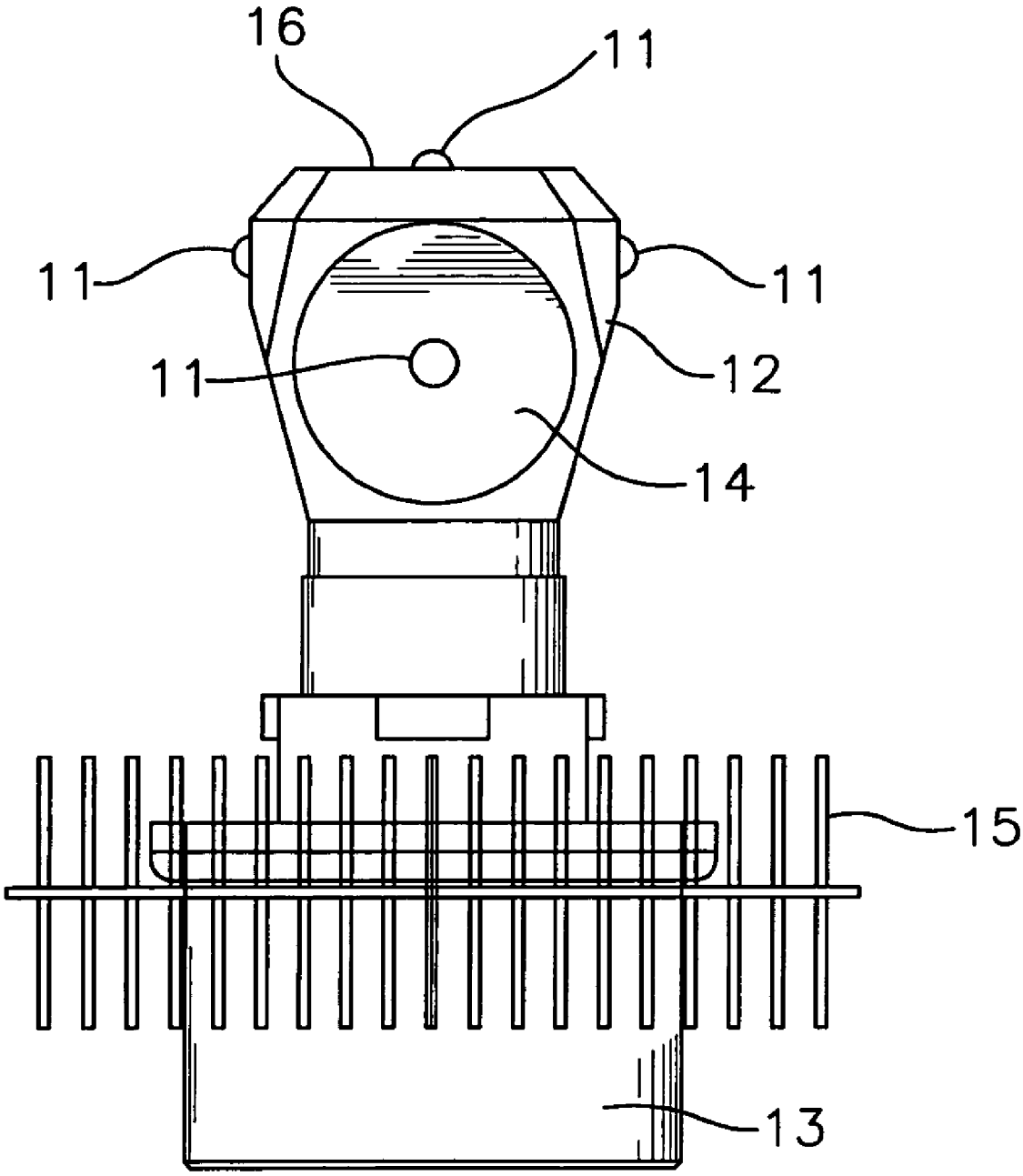
FIG. 9 is a side view of the embodiment of FIG. 8.

As shown in FIGS. 8 and 9, the pedestal 12 may be provided with two pairs of opposing faces 14 and associated LED's 11 mounted thereon, such that the LED's are positioned every 90 degrees. As before, the lateral faces 14 will occlude dispersion of the LED emitted light from portions of the reflective surface 21 in the same manner as the upper and lower faces 14. Continuing for example with the embodiment as representative of an automobile headlight, the lateral LED's 11 may be utilized to laterally project white light when the vehicle is turning to the left or right, or to project flashing turn signals or even emergency flashers.

Figure 12:
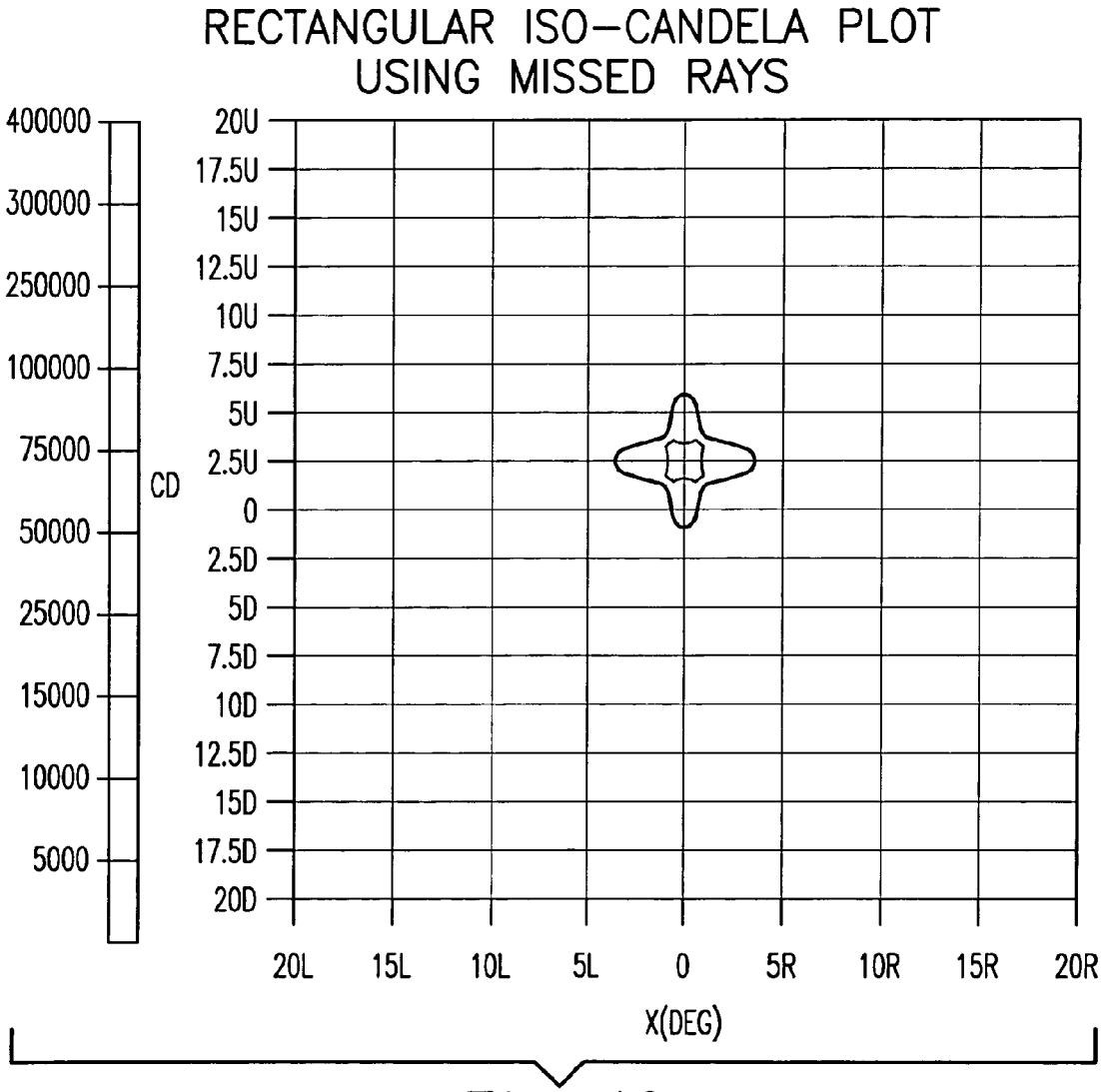
FIG. 12 illustrates the projected rectangular Iso-Candela beam pattern with a four (4) LED pedestal, with the LED's mounted every 90 degrees on the LED's pedestal aligned upon the reflector for projecting a spotlight beam pattern.

Alternatively, if the angles of the faces 14 and positioning of the LED's 11 are matched, a spotlight beam may be produced with all LED's 11 illuminated, the beam pattern being illustrated in FIG. 12. Providing the pedestal 12 with two more pairs of opposing faces 14, such that the cross-section of the pedestal 12 is generally octagonal and the LED's 11 are positioned every 45 degrees, would produce a beam pattern that is substantially circular. FIGS. 8 and 9 also illustrate an embodiment having an LED 11 positioned on the forward end of the pedestal 12 for direct, non-reflected illumination in the forward direction.

Figure 10:
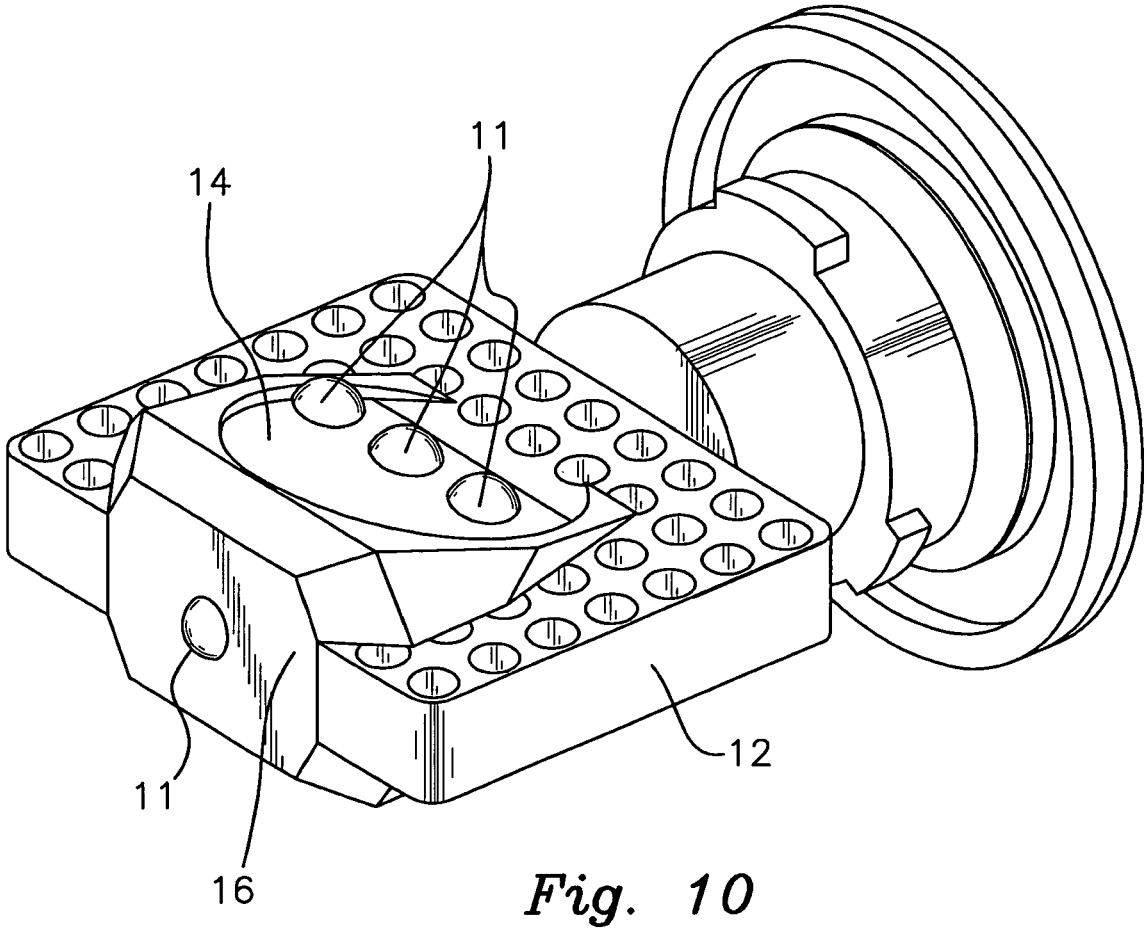
FIG. 10 is a forward perspective view of an embodiment of the operational components comprising multiple LED's mounted to one of the occluding faces.
Figure 13:
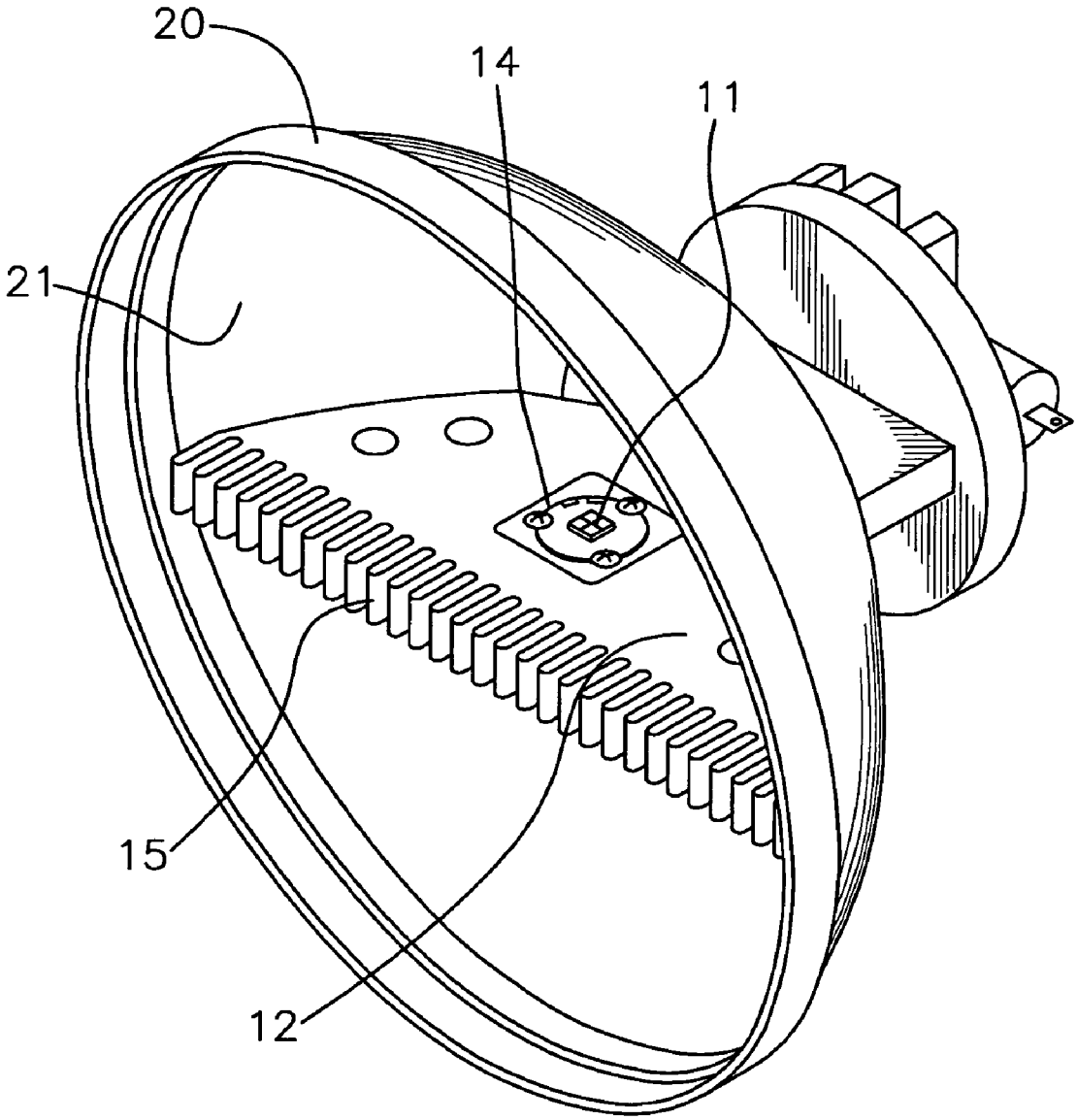
FIG. 13 is an embodiment showing a pedestal having a pair of opposing parallel faces and bisecting the reflector surface.

An alternative embodiment is shown in FIG. 10, wherein a grouping of three LED's 11 are positioned on one of the faces 14. The LED's on this face 14 may be the same or different colors, may operate independently or collectively, and be steady or intermittent. Still another embodiment for the pedestal 12 is shown in FIG. 13, where the pair of opposing faces 14 are generally parallel and extend laterally so as to generally bisect the reflective surface 21.

Figure 11:
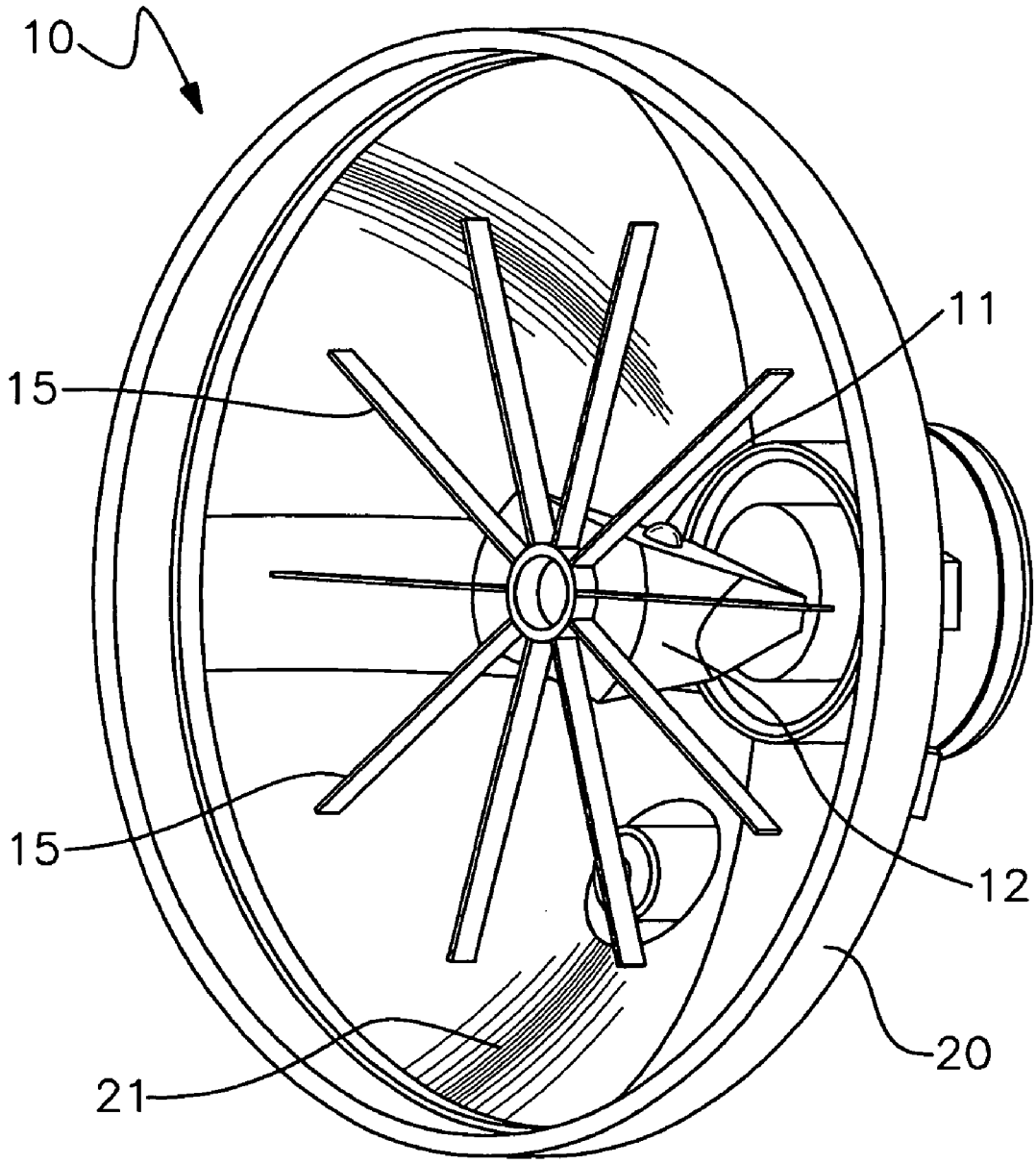
FIG. 11 is a forward perspective view of an embodiment showing a radially-finned heat sink member positioned on the forward end of the pedestal.

Because the heat produced by the LED's 11 is detrimental to their longevity, secondary heat sink members 15 may be provided to assist in heat dispersion in addition to the pedestal member 12. FIGS. 8 and 9 illustrate an additional heat sink member 15 annular disposed about the base of the pedestal 12. In FIG. 11, the heat sink member 15 is positioned to the front of the pedestal 12 and configured as a plurality of radially extending blade members that may contact the back of the cover lens. With this structure, the dissipating heat may be utilized to defog or defrost the cover lens of the lamp housing 20.

The examples set forth above are representational and are not meant to be limiting. It is contemplated and understood that equivalents and substitutions to certain elements set forth above may by obvious to those knowledgeable in the art, and therefore the true scope and definition of the invention is to be as set forth in the following claims.

I claim:

1. A light emitting diode (LED) reflective lamp comprising:

a housing comprising a reflective surface defining an interior area and a central axis;

a pedestal member extending into said interior area of said reflective surface, said pedestal member composed of a material that functions as a heat sink;

said pedestal member comprising at least two occluding faces oriented parallel to or rearward at an acute angle to said central axis;

said at least two occluding faces extending laterally and bisecting said reflective surface of said housing;

at least one LED disposed on each of said at least two occluding faces;

each of said at least two occluding faces allowing light emitted from said at least one LED disposed thereon to strike only a target portion of said reflective surface while precluding light emitted from said at least one LED from striking other portions of said reflective surface, wherein the target portion of one of said at least two occluding faces is different from the target portion of the other of said at least two occluding faces.

2. The lamp of claim 1, wherein each of said at least two occluding faces is oriented at an acute angle between zero and 30 degrees to said central axis.

3. The lamp of claim 2, wherein each of said at least two occluding faces is oriented at an angle to said central axis of less than about 30 degrees.

4. The lamp of claim 1, wherein each of said at least two occluding faces are parallel to said central axis.

5. The lamp of claim 1, wherein each of said at least two occluding faces is planar.

6. The lamp of claim 1, wherein said at least two occluding faces comprises a pair of opposing faces oriented at approximately 180 degrees about said central axis.

7. The lamp of claim 6, further comprising a non-reflecting LED positioned on the forward end of said pedestal member.

8. The lamp of claim 1, wherein said LED's are independently controlled.

9. The lamp of claim 1, wherein said reflective surface is parabolic.

10. The lamp of claim 1, wherein said at least two occluding faces of said pedestal contact said housing reflective surface such that heat from said LED's pass through said pedestal into said reflective surface.

* * * * *